US006533147B1

(12) United States Patent
Boisdequin

(10) Patent No.: US 6,533,147 B1
(45) Date of Patent: Mar. 18, 2003

(54) POURING TUBE

(75) Inventor: Vincent Boisdequin, Naast (BE)

(73) Assignee: Vesuyius Crucible Company, Wilmington, DE (US)

( * ) Notice: Subject to any disclaimer, the term of this patent is extended or adjusted under 35 U.S.C. 154(b) by 0 days.

(21) Appl. No.: 09/857,533

(22) PCT Filed: Nov. 16, 1999

(86) PCT No.: PCT/BE99/00147

§ 371 (c)(1),
(2), (4) Date: Jun. 6, 2001

(87) PCT Pub. No.: WO00/35614

PCT Pub. Date: Jun. 22, 2000

(30) Foreign Application Priority Data

Dec. 15, 1998 (BE) ..... 9800897

(51) Int. Cl.[7] ..... B22D 41/08
(52) U.S. Cl. ..... 222/606; 222/597; 222/607
(58) Field of Search ..... 222/600, 597, 222/606, 607; 164/437, 337

(56) References Cited

U.S. PATENT DOCUMENTS

| | | | | |
|---|---|---|---|---|
| 4,669,528 A | | 6/1987 | Szadkowski | |
| 5,170,915 A | | 12/1992 | Szadkowski | |
| 5,390,902 A | | 2/1995 | Szadkowski | |
| 5,467,904 A | | 11/1995 | Shaw | |
| 5,558,801 A | | 9/1996 | Tsukahara et al. | |
| 5,691,061 A | * | 11/1997 | Hanse et al. | 222/606 |
| 5,866,022 A | * | 2/1999 | Hall | 222/600 |
| 5,954,989 A | * | 9/1999 | Brook et al. | 222/600 |

FOREIGN PATENT DOCUMENTS

| | | |
|---|---|---|
| EP | 0 659 506 A | 6/1995 |
| WO | WO 89/02800 A | 4/1989 |

* cited by examiner

*Primary Examiner*—Scott Kastler
(74) *Attorney, Agent, or Firm*—James R. Williams

(57) ABSTRACT

The present invention concerns a pouring tube of refractory material comprised of a tubular element and equipped at its upper end with a plane plate, the side faces and lower face of the said plate and the upper end of the tubular part being protected by a metallic case, said plate being reinforced in its lower face by mechanical means that increase its stiffness that is characterized in that these stiffening means are comprised of a plurality of U-shaped metallic pieces located on either side of the tube and attached fixedly to the part of the metal case protecting the lower face of the plate. These tubes present a greater resistance to the formation of cracks than conventional tubes.

13 Claims, No Drawings

POURING TUBE

BACKGROUND OF THE INVENTION

1. Field of the Invention

The present invention concerns a pouring tube for conveying a molten metal from an upper metallurgical vessel to a lower one. In particular, it concerns a pouring tube of refractory material for the transfer of molten steel from a distributor to an ingot mold or alternatively from a pouring ladle to a distributor.

2. Description of the Prior Art

Pouring tubes designed to convey the molten metal from one metallurgical vessel to another are wear pieces highly stressed to the point that their service life could limit the pouring time. Numerous devices for introducing and changing the tube described recently in the prior art permitted resolving this problem. See, e.g., European Patents 192019 and 441927. As soon as the erosion in the vicinity of the meniscus, and even sometimes inside of the pouring tube, reaches a certain level, the worn tube is replaced with a new tube within a sufficiently short time so as not to interrupt the pouring. In these devices, a pouring tube comprises a tubular piece equipped at its upper end with a plane plate designed to slide in guides against the lower plane face either of a pouring orifice such as a nozzle or of a fixed bottom plate coupled to a mechanism for regulating the pouring jet inserted between the pouring orifice (e.g., nozzle) and the pouring tube is generally used.

These tubes can be in one piece or can consist of an assembly of several refractory pieces. In most cases, the side faces of the plate, the lower face of the plate and the upper end of the tubular part of the tube are protected by a metal case.

Despite the considerable advantages imparted to the state of the art by the systems described above and the continuous improvement that they have undergone in recent years, there are still some problems.

In particular, the appearance of cracks or microcracks is frequently observed in the pouring tube at the level of the junction between the tubular piece and the plate located at the upper end of the tubular piece. These cracks or microcracks can occur from the preheating of the tube prior to its use, the first moments of its use or during its use.

Even if these cracks have a negligible size in some cases, they must be taken into account. The passage of the molten metal in the tube induces a substantial aspiration of ambient air. Atmospheric oxygen or even nitrogen are substantial sources of contamination of the molten metal, in particular, steel. In addition, under the combined action of oxygen and very high temperatures, the refractory material can be considerably degraded at the point of arrival of oxygen, i.e., the crack. This degradation further contributes to a local deterioration of the refractory material and enlarges the crack to the point that it could be necessary to stop the pouring.

There are refractory materials more resistant to cracking. However, these materials are generally sensitive to other phenomena such as erosion, corrosion, etc. Furthermore, the cracking can be caused by a thermal shock, a mechanical shock or the application of excessively high mechanical stresses such as pressure or vibrations.

In particular, in a device for introducing and changing the tube, the plate undergoes substantial bending stresses perpendicular to its surface that may be responsible for the formation of cracks at the upper end of the tubular part. It is observed that the upper plate can be deformed by bending around an axis parallel to the direction of the guides in which the said plate slides. Thus, it is difficult to reach a compromise based only on the chemical composition of the refractory material that solves all these problems. The applicant thus undertook to find a means of reducing the formation of cracks in the pouring tube without having to modify the composition of the refractory material.

European patent application 601,700 discloses a pouring tube of refractory material comprised of a tubular element and equipped at its upper end with a plane plate. The side faces and lower faces of the said plate and the whole tubular part of this pouring tube are protected by a metal case. A reinforcing cone surrounds the upper end of the tubular part.

Such a reinforcing cone stiffens homogeneously the structure all around the upper end of the tubular part. However, as explained above, it has been observed that, in case of use in a device for introducing and changing a pouring tube, the pouring tube is subject to constraints which are not homogeneously distributed. Moreover, its large hindrance prevents the use of a cone reinforced tube such as disclosed in the European patent application 601,700 in a device for introducing and changing a pouring tube.

Other reinforcing means for refractory pouring tubes are known in the art such as for example WO 8902800 and WO 9220480, wherein the metal jacket itself is said to strengthen the tube.

SUMMARY OF THE INVENTION

The present invention thus concerns a pouring tube of refractory material comprised of a tubular element and equipped at its upper end with a plane plate, the side faces and lower face of the said plate and the upper end of the tubular part being protected by a metallic case, said plate being reinforced in its lower face by mechanical means that increase its stiffness that is characterized in that these stiffening means are comprised of a plurality of U-shaped metallic pieces, at least one being arranged on each side of the tube and attached fixedly to the part of the metal case protecting the lower face of the plate, and to the upper end of the tubular part.

DETAILED DESCRIPTION OF THE INVENTION

Preferably, the attachment means of the U-shaped pieces comprises at least two linear welds arranged on either sides of and in contact with the upper end of the tubular part and parallel to the direction of the guides (sliding direction). These welds fixedly attach the ends of the U-shaped piece to the lower face of the plate and tangentially to the tubular part.

Advantageously, the gaps between the ends.of the respective U-shaped elements are filled with another weld which extends orthogonaly to the plate, forming a T-shaped weld with the linear weld attaching the U-shaped piece to the lower face of the plane plate.

In this case, it is also preferable that the U-shaped pieces permit at least a limitation of the bending of the plate around an axis parallel to the direction of the guides in which the said plate slides. To this end, the U-shaped pieces can be disposed so that their side branches are parallel to the direction of the guides.

The side branches of the U-shaped pieces advantageously have a length such that the ends of the two U-shaped pieces are close to each other and can even be in mutual contact.

According to this form of implementation, the plate is rendered more rigid in two perpendicular directions. The U-shaped pieces are preferably arranged so that their side branches are parallel to the direction of the guides; in this manner, the bending of the plate around axes parallel and perpendicular to the direction of the guides in which the said plate slides is limited.

These pieces have the effect of increasing the height of the piece subjected to bending stresses and consequently increase its bending inertia. These pieces have a height between 1 and 20 cm, preferably between 2 and 8 cm.

The applicant was able to determine that the pouring tubes according to the present invention became cracked definitely less than conventional tubes. In the case of a pouring tube for conveying a molten metal from a distributor to an ingot mold, the lower end of the pouring tube quite frequently has two lateral openings for the flow of molten metal into the ingot mold. These openings located on either side of the tube should be oriented in the ingot mold along an axis parallel to the larger dimension of the ingot mold. It is imperative that the pouring tube engages correctly in the ingot mold. A wrongly oriented tube would induce a flow of the molten metal toward the walls of the ingot mold and would be responsible for substantial perturbations in solidification zone of the metal. These perturbations can result in a laceration of the skin of the solidifying slab and thus a breakthrough of molten metal under the ingot mold. To avoid orienting a replacement pouring tube wrongly in a device for introducing and changing a pouring tube, it was proposed to provide the lower face of the plane plate with an anti-inversion device. This device gives the part of the plate designed to slide in the guides an asymmetric (rectangular or ellipsoidal) form so that it is impossible to engage the plate in the said guides with an unintended orientation. The U.S. Pat. No. 5,188,743, for example, describes such a system.

Advantageously, the mechanical means that increase the stiffness of the plate also serve as anti-inversion device. For this purpose, they are arranged around the tubular part of the pouring tube in an asymmetric manner so that the tube cannot be engaged with an incorrect orientation in a device for introducing and changing the tube.

During the development of the present invention, the applicant also found that in some cases the very high temperatures reached by the different parts of the pouring tube during the passage of the molten metal can cause a softening of the mechanical means reputed to increase the rigidity of the plate and strip them of any efficacy. This problem, when it was observed, could be resolved by using pieces having a heat-dissipating structure. For example, the lower end of the said pieces can be indented or crenellated to induce a substantial air circulation at their level. In a variant or in combination, at least a part of these pieces can also be provided with fins in order to induce a substantial air circulation at their level.

What is claimed is:

1. A refractory pouring tube adapted to travel in a sliding direction within a tube-changing device comprising:

a) a tubular part comprising an upper end and a plane plate upstream from the upper end, the plane plate having a plurality of side faces and at least one lower face;

b) a metal case covering a portion of the upper end, the lower face and a plurality of the side faces; and c) at least two U-shaped reinforcements, each having two arms, arranged around the tube and fixedly secured to the metal case at the lower face and the upper end of the tubular part.

2. The refractory pouring tube of claim 1, wherein the U-shaped reinforcements are secured to the metal case with at least two linear welds arranged on opposite sides of and in contact with the upper end of the tubular part and parallel to the sliding direction.

3. The refractory pouring tube of claim 1, wherein the U-shaped reinforcements reduce the flexion of the plane plate around an axis parallel to the sliding direction.

4. The refractory pouring tube of claim 1, wherein the U-shaped reinforcements are arranged around the tube such that the arms of adjacent U-shaped reinforcements are separated by a gap.

5. The refractory pouring tube of claim 4, wherein the gap is filled in with a weld that extends orthogonally from the lower face of the plate.

6. The refractory pouring tube of claim 5, wherein the U-shaped reinforcements are secured to the metal case with at least two linear welds arranged on opposite sides of and in contact with the upper end of the tubular part and parallel to the sliding direction, and the weld forms a T-shaped weld with the linear weld attaching the U-shaped piece to the lower face of the plane plate.

7. The refractory pouring tube of claim 1, wherein the U-shaped elements are arranged with their arms parallel to the sliding direction.

8. The refractory pouring tube of claim 1, wherein the U-shaped reinforcements are non-symmetrically arranged around the tubular part of the pouring tube so as the tube can not be incorrectly introduced in the tube-changing device.

9. The refractory pouring tube of claim 1, wherein the U-shaped reinforcements include a cooling structure selected from the group consisting of indentations, crenellations and fins.

10. The refractory pouring tube of claim 9, wherein the U-shaped reinforcements comprise a lower part away from the lower face of the plane plate, and-the lower part comprises the cooling structure.

11. A refractory assembly comprising a tube-changing device and a pouring tube capable of being inserted into and traveling in a sliding direction within the device, the pour tube comprising:

a) a tubular part having an upper end comprising a plane plate, the plane plate having a plurality of side faces and at least one lower face;

b) a metal case covering a portion of the upper end, the lower face and a plurality of the side faces; and c) at least two U-shaped reinforcements, each having two arms, arranged around the tube and fixedly secured to the metal case at the lower face and the upper end of the tubular part, wherein the U-shaped reinforcements prevent misinsertion in the tube-changing device.

12. The refractory assembly of claim 11, wherein the U-shaped reinforcements are non-symmetrically arranged around the tubular part of the pouring tube so as the tube can not be incorrectly introduced in the tube-changing device.

13. The refractory assembly of claim 11, wherein the U-shaped reinforcements include a cooling structure selected from the group consisting of indentations, crenellations and fins.

* * * * *

UNITED STATES PATENT AND TRADEMARK OFFICE

CERTIFICATE OF CORRECTION

PATENT NO. : 6,533,147 B1
DATED : March 18, 2003
INVENTOR(S) : Vincent Boisdequin It is certified that error appears in the above-identified patent and that said Letters Patent is hereby corrected as shown below:

Title page,
Item [73], Assignee, delete "Vesuyius Crucible Company" and insert therefor -- Vesuvius Crucible Company --.

Column 2,
Line 54, delete "ends.of" and insert therefor -- ends of --.

Column 4,
Line 39, delete "and-the" and insert therefor -- and the --.

Signed and Sealed this

Twenty-third Day of November, 2004

JON W. DUDAS
*Director of the United States Patent and Trademark Office*